US008337184B2

(12) United States Patent
Hossain et al.

(10) Patent No.: US 8,337,184 B2
(45) Date of Patent: Dec. 25, 2012

(54) SINGLE SCREW COMPRESSOR STRUCTURE

(75) Inventors: Mohammod Anwar Hossain, Sakai (JP); Kaname Ohtsuka, Sakai (JP); Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 586 days.

(21) Appl. No.: 12/599,701

(22) PCT Filed: May 12, 2008

(86) PCT No.: PCT/JP2008/058733

§ 371 (c)(1), (2), (4) Date: Nov. 11, 2009

(87) PCT Pub. No.: WO2008/140071

PCT Pub. Date: Nov. 20, 2008

(65) Prior Publication Data

US 2010/0247364 A1 Sep. 30, 2010

(30) Foreign Application Priority Data

May 14, 2007 (JP) ..... 2007-128474

(51) Int. Cl.

| | |
|---|---|
| ***F03C 4/00*** | (2006.01) |
| ***F04C 2/00*** | (2006.01) |
| ***F04C 18/00*** | (2006.01) |

(52) U.S. Cl. ..... 418/195; 418/197

(58) Field of Classification Search ..... 418/15, 418/194, 195, 197; 74/425, 458, 462

See application file for complete search history.

(56) References Cited

U.S. PATENT DOCUMENTS

| | | | | | |
|---|---|---|---|---|---|
| 2,279,414 | A | * | 4/1942 | Scott | 74/458 |
| 2,931,308 | A | * | 4/1960 | Luthi | 418/194 |
| 3,133,695 | A | * | 5/1964 | Zimmern | 418/195 |
| 3,632,239 | A | | 1/1972 | Zimmern | |
| 4,028,016 | A | * | 6/1977 | Keijer | 418/195 |
| RE30,400 | E | | 9/1980 | Zimmern | |
| 4,484,872 | A | | 11/1984 | Ohtsuki | |
| 4,775,304 | A | * | 10/1988 | Bein | 418/195 |
| 5,533,887 | A | * | 7/1996 | Maruyama et al. | 418/201.3 |
| 6,398,532 | B1 | | 6/2002 | Zha et al. | |
| 2004/0037730 | A1 | | 2/2004 | Ueno et al. | |

FOREIGN PATENT DOCUMENTS

| | | | |
|---|---|---|---|
| JP | 56-12091 | A | 2/1981 |
| JP | 57-99986 | U | 6/1982 |
| JP | 58-122301 | A | 7/1983 |
| JP | 2002-202080 | A | 7/2002 |

* cited by examiner

*Primary Examiner* — Theresa Trieu

(74) *Attorney, Agent, or Firm* — Global IP Counselors

(57) ABSTRACT

A single screw compressor structure includes a screw rotor and a casing. The screw rotor has a plurality of helical grooves formed in an outer peripheral surface thereof. The casing houses the screw rotor. The screw rotor includes a main tapered portion having a tapered outer diameter that becomes larger from an intake side toward a discharge side of the screw rotor, and a reversely tapered portion that is located on a downstream side of a maximum outer diameter portion of the outer surface and on the discharge side of the main tapered portion. The reversely tapered portion has a reversely tapered outer diameter that becomes smaller as the reversely tapered portion extends away from the maximum outer diameter portion.

12 Claims, 5 Drawing Sheets

SINGLE SCREW COMPRESSOR STRUCTURE

CROSS-REFERENCE TO RELATED APPLICATIONS

This U.S. National stage application claims priority under 35 U.S.C. §119(a) to Japanese Patent Application No. 2007-128474, filed in Japan on May 14, 2007, the entire contents of which are hereby incorporated herein by reference.

TECHNICAL FIELD

The present invention relates to a single screw compressor.

BACKGROUND ART

Conventionally, a variety of compressors have been proposed for compressing a compressed medium such as refrigerant in a refrigeration machine, and among those, single screw compressors are known for having small vibration and noise and high reliability.

As described in JP-A No. 2002-202080, there is a single screw compressor that is equipped with a cylindrical screw rotor that has plural helical grooves in its outer peripheral surface, at least one gate rotor that rotates while meshing with the screw rotor, and a casing that houses the screw rotor. A compressed medium such as refrigerant is delivered to the helical grooves in the screw rotor rotating inside the casing, is compressed inside a space enclosed by the helical grooves, teeth of the gate rotor and the casing, and is discharged from a discharge port in the casing.

Further, as described in U.S. Pat. RE 30,400, there is a single screw compressor that is equipped with a screw rotor that has a tapered shape or a reversely tapered shape where its outer diameter changes from an intake side toward a discharge side and a pinion that rotates while meshing with helical grooves in the screw rotor. In this single screw compressor described in U.S. Pat. RE 30,400 also, a compressed medium such as refrigerant is delivered to the helical grooves in the screw rotor rotating inside the casing, is compressed inside a space enclosed by the helical grooves, teeth of the pinion and the casing, and is discharged from a discharge port in the casing.

SUMMARY OF THE INVENTION

Technical Problem

However, in the case of the screw rotor with the tapered shape described in U.S. Pat. RE 30,400, in a tapered shape where the diameter on the discharge side is small, there is the problem that the discharge port becomes small and compression loss becomes large. Further, even in the case of the screw rotor with the cylindrical shape described in JP-A No. 2002-202080, the discharge port cannot be sufficiently ensured and reducing compression loss is difficult.

Thus, using a screw rotor that has a tapered shape where the diameter on the discharge side is large has been proposed in order to reduce compression loss. However, in this screw rotor that has a tapered shape where the diameter on the discharge side is large, compression loss is reduced but new problems arise in that the axial-direction load acting on the screw rotor becomes large and the load balance in the axial direction becomes large.

It is an object of the present invention to provide a single screw compressor that is capable of decreasing the axial-direction load acting on the screw rotor.

Solution to Problem

A single screw compressor structure according to a first aspect of the present invention is equipped with a screw rotor and a casing. The screw rotor has plural helical grooves in its outer peripheral surface and has a tapered shape where its outer diameter becomes larger from an intake side toward a discharge side. The casing houses the screw rotor. The screw rotor has a reversely tapered portion. The reversely tapered portion is located on a downstream side of a maximum outer diameter portion on the discharge side in the outer peripheral surface having the helical grooves and has a reversely tapered shape where its outer diameter becomes smaller from the maximum outer diameter portion.

Here, the screw rotor has the reversely tapered portion that is located on the downstream side of the maximum outer diameter portion on the discharge side in the outer peripheral surface having the helical grooves and has a reversely tapered shape where its outer diameter becomes smaller from the maximum outer diameter portion, so the force with which a compressed medium pushes the screw rotor along the axial direction toward the discharge side is counteracted by the force with which the compressed medium pushes the reversely tapered portion back toward the intake side, whereby it is possible to decrease the axial direction load acting on the screw rotor.

A single screw compressor structure according to a second aspect of the present invention is the single screw compressor according to the first aspect of the invention, wherein a first discharge port opens in a place in an outer peripheral surface of the casing that faces the reversely tapered portion.

Here, the first discharge port opens in a place in the outer peripheral surface of the casing that faces the reversely tapered portion, so the first discharge port for discharging refrigerant that has been compressed inside the casing can be made large; thus, discharge pressure loss can be reduced and overcompression can be prevented.

A single screw compressor structure according to a third aspect of the present invention is the single screw compressor according to the second aspect of the invention, wherein a second discharge port opens in a place in the outer peripheral surface of the casing on the intake side of the maximum outer diameter portion.

Here, the second discharge port opens in a place in the outer peripheral surface of the casing on the intake side of the maximum outer diameter portion, so discharge area can be sufficiently ensured.

A single screw compressor structure according to a fourth aspect of the present invention is the single screw compressor according to the third aspect of the invention, wherein the first discharge port and the second discharge port are capable of being communicated at the same time with two of the grooves that are adjacent in the outer peripheral surface of the screw rotor when the screw rotor rotates.

Here, the first discharge port and the second discharge port are capable of being communicated at the same time with two of the grooves that are adjacent in the outer peripheral surface of the screw rotor when the screw rotor rotates, so it is possible to prevent midstream compression between the first discharge port and the second discharge port and to eliminate imbalance in the discharge pressure.

A single screw compressor structure according to a fifth aspect of the present invention is the single screw compressor according to the third aspect or the fourth aspect of the invention, wherein the first discharge port and the second discharge port are communicated in the outer peripheral surface of the casing.

Here, the first discharge port and the second discharge port are communicated in the outer peripheral surface of the casing, so a wide discharge area can be ensured and forming the discharge ports becomes easy.

A single screw compressor structure according to a sixth aspect of the present invention is the single screw compressor according to any of the first aspect to the fifth aspect of the invention, wherein, in the portion of the screw rotor where the grooves are formed, the outer diameter of a discharge side end portion is larger than the outer diameter of an intake side end portion.

Here, in the portion of the screw rotor where the grooves are formed, the outer diameter of the discharge side end portion is larger than the outer diameter of the intake side end portion, so it is possible to sufficiently ensure the reversely tapered portion.

Advantageous Effects of Invention

According to the first aspect of the invention, the force with which the compressed medium pushes the screw rotor along the axial direction toward the discharge side is counteracted by the force with which the compressed medium pushes the reversely tapered portion back toward the intake side, whereby the axial direction load acting on the screw rotor can be decreased.

According to the second aspect of the invention, the first discharge port for discharging refrigerant that has been compressed inside the casing can be made large; thus, discharge pressure loss can be reduced and overcompression can be prevented.

According to the third aspect of the invention, discharge area can be sufficiently ensured.

According to the fourth aspect of the invention, midstream compression between the first discharge port and the second discharge port can be prevented and imbalance in the discharge pressure can be eliminated.

According to the fifth aspect of the invention, a wide discharge area can be ensured and forming the discharge ports becomes easy.

According to the sixth aspect of the invention, the reversely tapered portion can be sufficiently ensured.

DETAILED DESCRIPTION OF THE INVENTION

Figure 1:
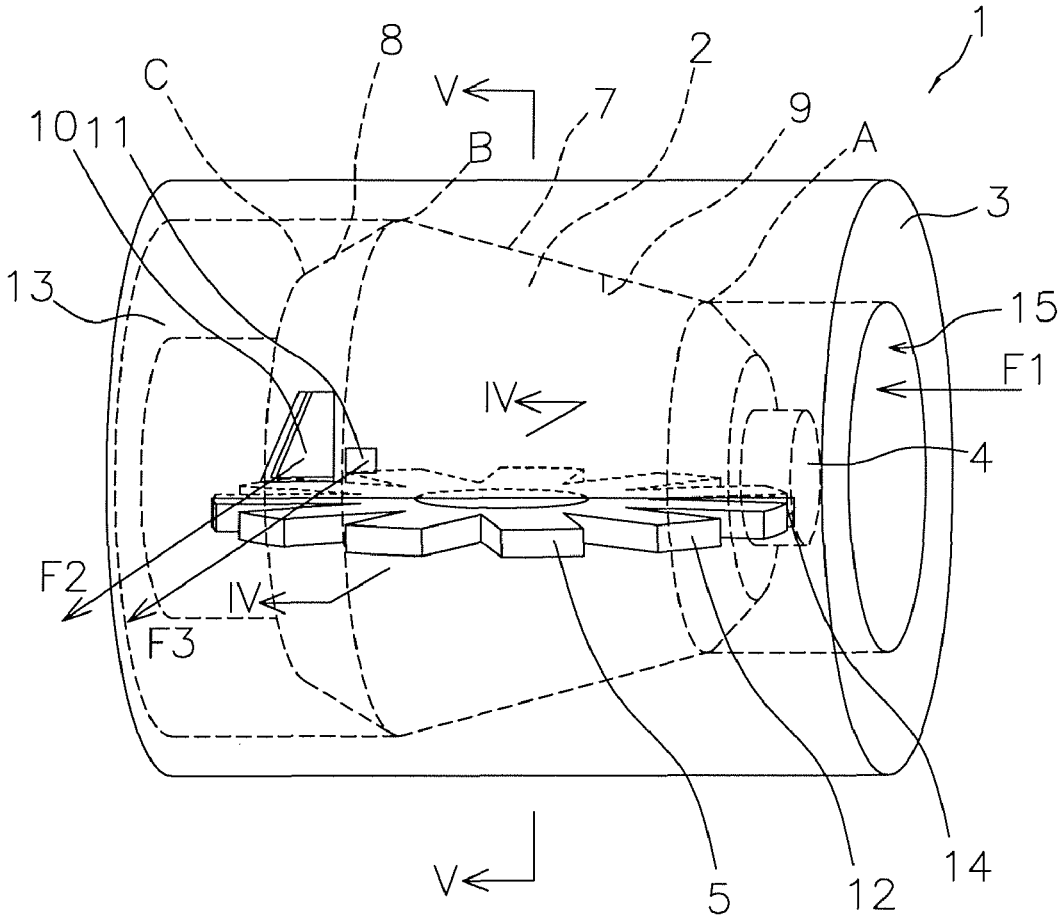
FIG. 1 is a configuration diagram of a single screw compressor pertaining to an embodiment of the present invention.

Next, an embodiment of a single screw compressor of the present invention will be described with reference to the drawings.

<Configuration of Single Screw Compressor 1>

A single screw compressor 1 shown in FIGS. 1 to 5 is equipped with a screw rotor 2, a casing 3 that houses the screw rotor 2, a shaft 4 that becomes a rotating shaft of the screw rotor 2, a gate rotor 5 and a thrust bearing 13.

The screw rotor 2 is a rotor that has plural helical grooves 6 in its outer peripheral surface and has a tapered shape where its outer diameter becomes larger from an intake side end portion A toward a discharge side end portion C (more specifically, a maximum outer diameter portion B). The screw rotor 2 is capable of rotating inside the casing 3 integrally with the shaft 4. The screw rotor 2 is supported by the thrust bearing 13 from a direction leading from a discharge side toward an intake side along an axial direction.

Further, the screw rotor 2 has a main tapered portion 7 whose outer diameter becomes larger in a tapered manner from the intake side end portion A to the maximum outer diameter portion B on the discharge side in the outer peripheral surface having the helical grooves 6 and a reversely tapered portion 8 that is located on a downstream side of the maximum outer diameter portion B and has a reversely tapered shape where its outer diameter becomes smaller from the maximum outer diameter portion B. The helical grooves 6 are formed continuously in the main tapered portion 7 and the reversely tapered portion 8.

Thus, the force with which a compressed medium such as refrigerant pushes the screw rotor 2 along the axial direction toward the discharge side end portion C is counteracted by the force with which the compressed medium pushes the reversely tapered portion back toward the intake side end portion A, whereby it is possible to decrease the axial direction load acting on the screw rotor 2 (e.g., a load where the compressed medium pushes the screw rotor 2 from the intake side end portion A toward the discharge side end portion C and a load where the thrust bearing 13 pushes back, which is the reaction force thereof).

Further, in the main tapered portion 7 and the reversely tapered portion 8 where the grooves 6 in the screw rotor 2 are formed, an outer diameter D1 of the discharge side end portion C is set so as to become larger than an outer diameter D2 of the intake side end portion A, so the range of the reversely tapered portion 8 can be sufficiently ensured.

The casing 3 is a member with a cylindrical shape and rotatably houses the screw rotor 2 and the shaft 4. The casing 3 has a tapered inner surface portion 9 whose inner diameter partially changes and which contacts the outer peripheral surface of the main tapered portion 7 of the screw rotor 2.

Further, a first discharge port 10 for discharging refrigerant that has been compressed inside the casing 3 opens in a place in the casing 3 that faces the reversely tapered portion 8.

Further, as a separate discharge port, a second discharge port 11 opens in a place in the outer peripheral surface of the casing 3 on the intake side of the maximum outer diameter portion B.

The first discharge port 10 and the second discharge port 11 respectively open in appropriate positions in the outer peripheral surface of the casing 3 such that they become capable of being communicated at the same time with two of the grooves 6 that are adjacent in the outer peripheral surface of the screw rotor 2 when the screw rotor 2 rotates. For that reason, it becomes possible to prevent midstream compression between the first discharge port 10 and the second discharge port 11 and to eliminate imbalance in the discharge pressure.

The gate rotor 5 is a rotor that has plural teeth 12 that mesh with the grooves 6 of the screw rotor 2 and is capable of rotating about a rotating shaft (not shown) that is substantially orthogonal to the shaft 4 that is the rotating shaft of the screw rotor 2. The teeth 12 of the gate rotor 5 are capable of meshing with the helical grooves 6 in the screw rotor 2 inside the casing 3 through a slit 14 that is formed in the casing 3.

The number of the grooves 6 with which the screw rotor 2 is equipped is 6, and the number of the teeth 12 with which the gate rotor 5 is equipped is 11. The number 6 of the grooves 6 and the number 11 of the teeth 12 are coprime, so the plural teeth 12 can mesh with the plural grooves 6 in order when this single screw compressor 1 operates.

<Description of Operation of Single Screw Compressor 1>

Figure 2:
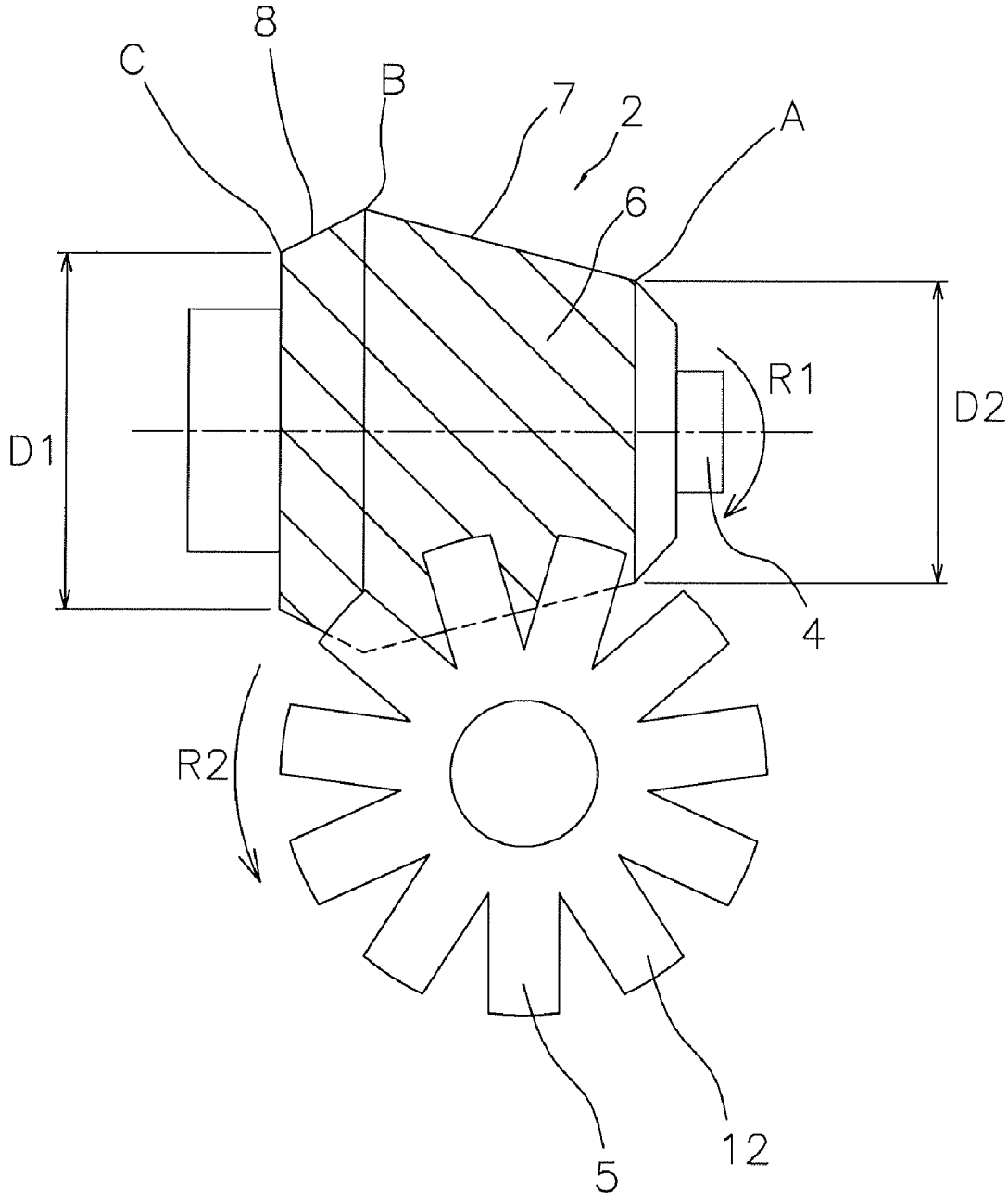
FIG. 2 is a front view of a screw rotor and a gate rotor of FIG. 1.
Figure 3:
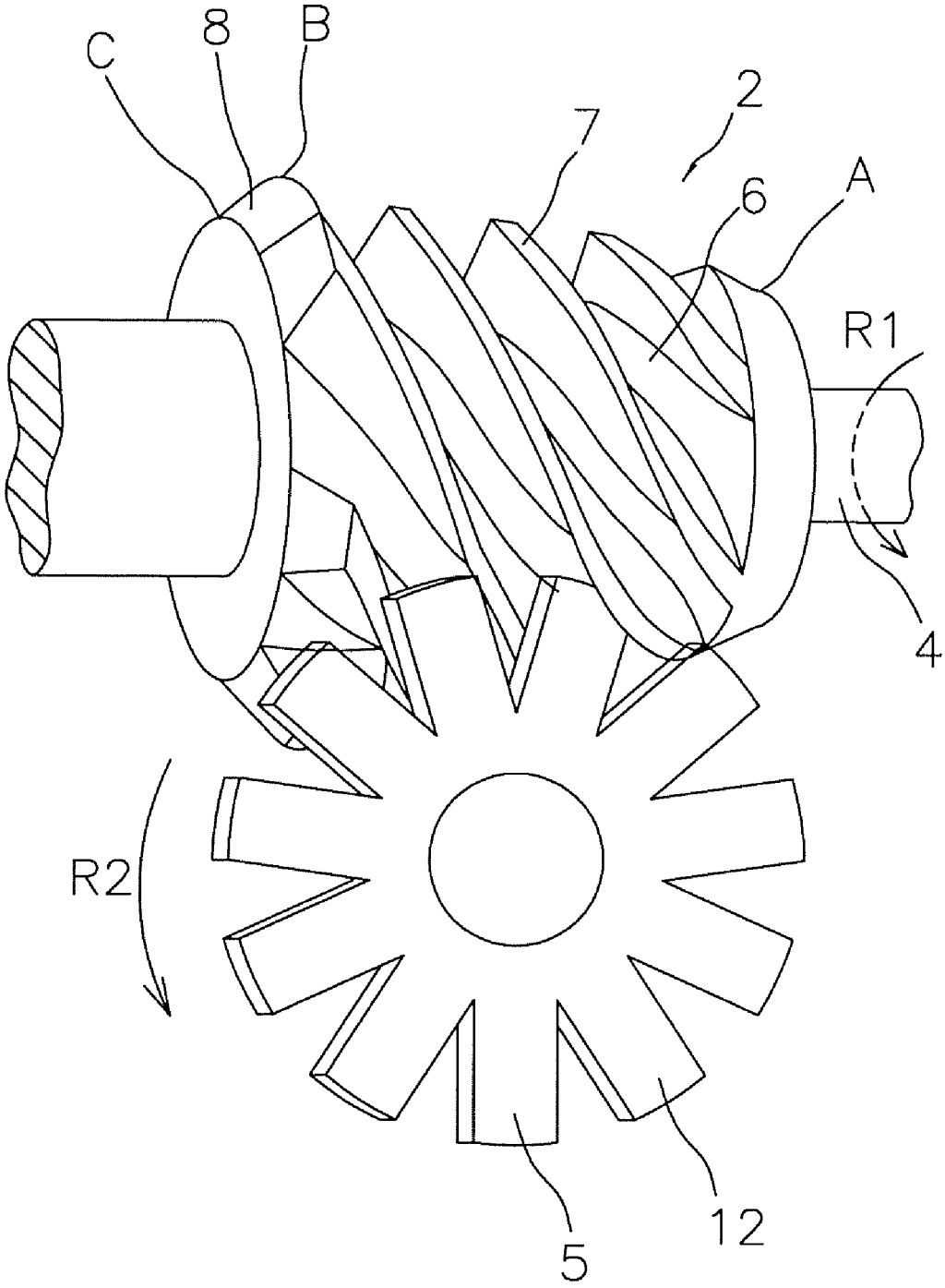
FIG. 3 is a perspective view of the screw rotor and the gate rotor of FIG. 1.
Figure 4:
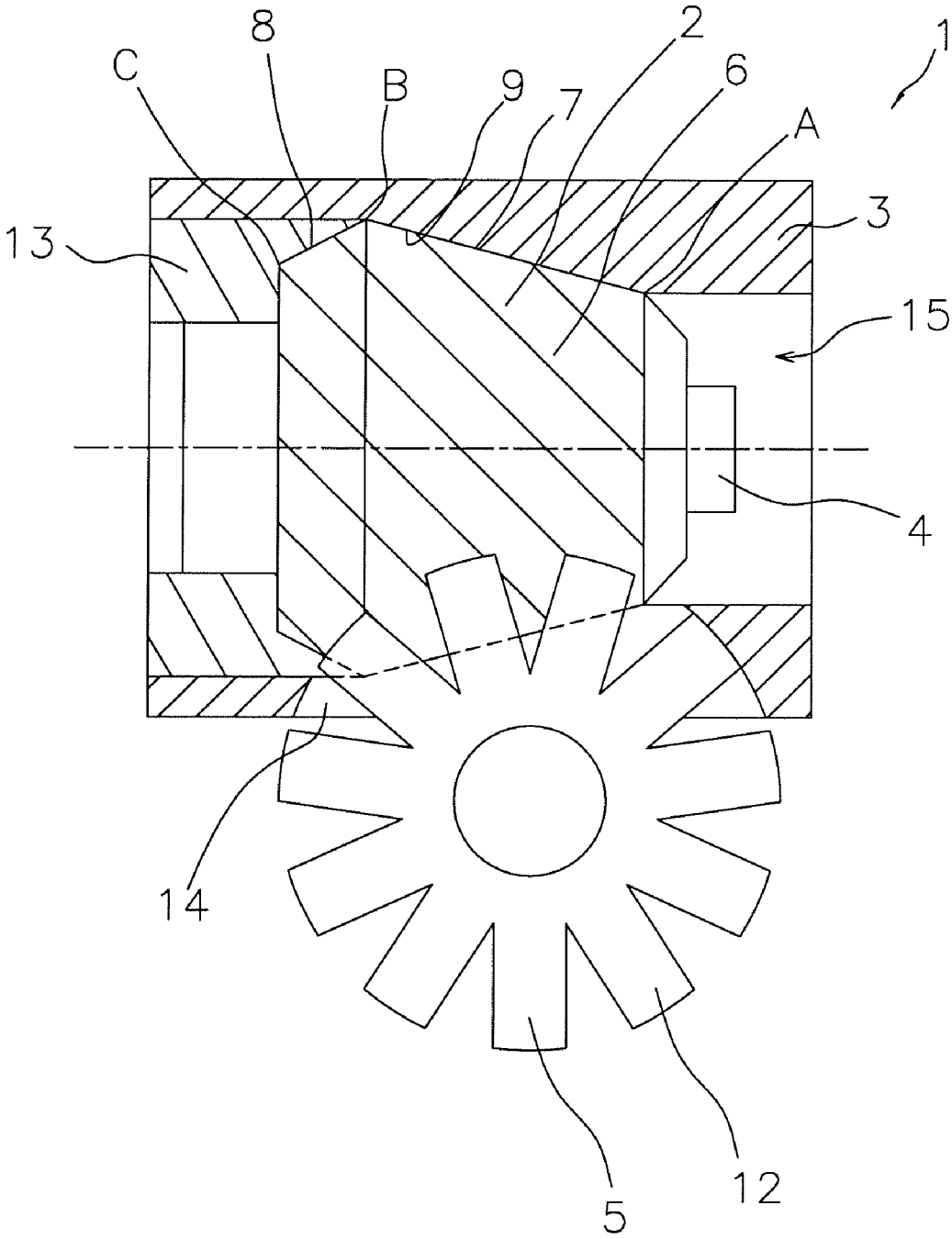
FIG. 4 is a cross-sectional view of the single screw compressor along line IV-IV of FIG. 1.
Figure 5:
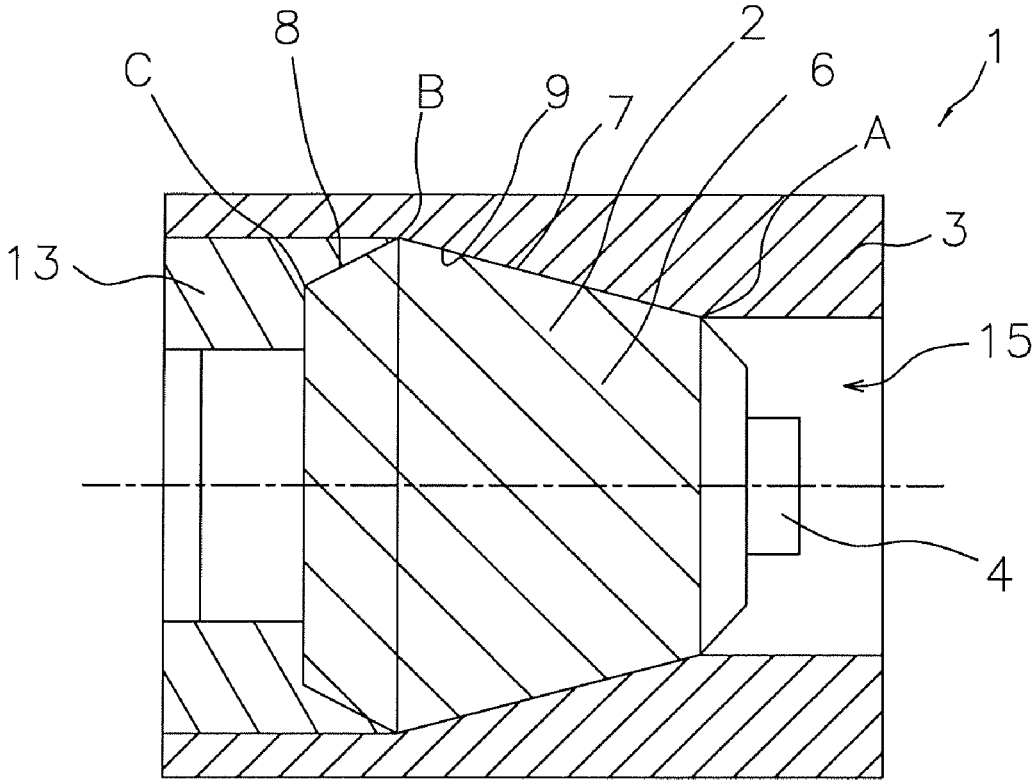
FIG. 5 is a cross-sectional view of the single screw compressor along line V-V of FIG. 1.

When the shaft 4 receives rotational driving force from a motor (not shown) outside the casing 3, the screw rotor 2 rotates in the direction of arrow R1 (see FIGS. 2 and 3). At this time, the gate rotor 5 that meshes with the helical grooves 6 in the screw rotor 2 rotates in the direction of arrow R2 as a result of its teeth 12 being pushed against inner walls of the helical grooves 6. At this time, the volume of a compression chamber that is partitioned off and formed by the inner surface of the casing 3, the grooves 6 in the screw rotor 2 and the teeth 12 of the gate rotor 5 decreases.

By utilizing this decrease in volume, refrigerant F1 (see FIG. 1) before compression that is introduced from an intake side opening 15 in the casing 3 is guided to the compression chamber just before the grooves 6 and the teeth 12 mesh, the volume of the compression chamber decreases such that the refrigerant is compressed while the grooves 6 and the teeth 12 are meshing, and thereafter refrigerant F2 and refrigerant F3 (see FIG. 1) that have been compressed are respectively discharged from the first discharge port 10 and the second discharge port 11 just after the grooves 6 and the teeth 12 become unmeshed.

At this time, the force with which the refrigerant pushes the main tapered portion 7 of the screw rotor 2 along the axial direction from the intake side end portion A toward the discharge side end portion C is counteracted by the force with which the refrigerant pushes the reversely tapered portion 8 back from the discharge side end portion C toward the intake side end portion A. Thus, it becomes possible to decrease the axial direction load acting on the screw rotor 2.

It will be noted that the main tapered portion 7 and the reversely tapered portion 8 are designed such that the force with which the refrigerant pushes the main tapered portion 7 always becomes larger than the force with which the refrigerant pushes the reversely tapered portion 8 so that the axial direction load acting on the screw rotor 2 does not fluctuate in the front-rear direction (end portion A→C direction and C→A direction in FIG. 2).

<Characteristics>

(1)

In the single screw compressor 1 of the embodiment, the screw rotor 2 has the main tapered portion 7 whose outer diameter becomes larger in a tapered manner from the intake side end portion A to the maximum outer diameter portion B on the discharge side in the outer peripheral surface having the helical grooves 6 and the reversely tapered portion 8 that is located on the downstream side of the maximum outer diameter portion B and has a reversely tapered shape where its outer diameter becomes smaller from the maximum outer diameter portion B.

Thus, the force with which the compressed medium such as refrigerant pushes the screw rotor 2 along the axial direction toward the discharge side B is counteracted by the force with which the compressed medium pushes the reversely tapered portion back toward the intake side end portion A, whereby it is possible to decrease the axial direction load acting on the screw rotor 2.

As a result, it becomes possible to control problems caused by the axial direction load, such as an expansion of the gap between the screw rotor 2 and the inner surface of the casing 3 or the occurrence of wear of a seal portion in the interface between the thrust bearing 13 and the screw rotor 2.

(2)

In the single screw compressor 1 of the embodiment, in the main tapered portion 7 and the reversely tapered portion 8 where the grooves 6 of the screw rotor 2 are formed, the outer diameter D1 of the discharge side end portion C is set so as to become larger than the outer diameter D2 of the intake side end portion A, so the range of the reversely tapered portion 8 can be sufficiently ensured.

(3)

In the single screw compressor 1 of the embodiment, the first discharge port 10 opens in a place in the casing 3 that faces the reversely tapered portion 8, so the first discharge port 10 for discharging refrigerant that has been compressed inside the casing 3 can be made large. Consequently, discharge pressure loss can be reduced and overcompression can be prevented.

More specifically, at the main tapered portion 7, the pressure of the refrigerant builds up when the refrigerant approaches toward the maximum outer diameter portion B, but at the reversely tapered portion that is on the downstream side of the maximum outer diameter portion B, the pressure of the refrigerant is already at a predetermined discharge pressure, so it is possible to obtain a fixed pressure ratio even when the first discharge port 10 is made large.

(4)

In the single screw compressor 1 of the embodiment, the second discharge port 11 opens in a place in the outer peripheral surface of the casing 3 on the intake side of the maximum outer diameter portion B, so discharge area can be sufficiently ensured.

(5)

In the single screw compressor 1 of the embodiment, the first discharge port 10 and the second discharge port 11 respectively open to the outer peripheral surface of the casing 3 such that it becomes possible for them to be communicated at the same time with two of the grooves 6 that are adjacent in the outer peripheral surface of the screw rotor 2 when the screw rotor 2 rotates. Consequently, midstream compression between the first discharge port 10 and the second discharge port 11 can be prevented and imbalance in the discharge pressure can be eliminated.

<Modifications>

(A)

In the preceding embodiment, the first discharge port 10 and the second discharge port 11 are formed separately from each other in the outer peripheral surface of the casing 3, but the present invention is not limited to this. As a modification of the present invention, the first discharge port 10 and the second discharge port 11 may also be communicated with each other in the outer peripheral surface of the casing 3; in this case, a wider discharge area can be ensured and forming the discharge ports becomes easy.

(B)

It will be noted that, in the embodiment, an example has been described where the single screw compressor has the first discharge port 10 and the second discharge port 11, but the present invention is not limited to this; the single screw compressor may also have just the first discharge port.

(C)

Further, shutters that change the opening areas may also be disposed in the first discharge port 10 and the second discharge port 11 so that the discharge amount or the discharge pressure of the refrigerant can be changed.

INDUSTRIAL APPLICABILITY

The present invention is capable of being applied to a single screw compressor. In particular, the present invention can be suitably applied to a screw compressor that is built into a chiller or a heat pump and the like. Further, the present invention can also be applied to a variable refrigerant volume (VRV) type of compressor.

What is claimed is:

1. A single screw compressor structure comprising:

a screw rotor having a plurality of helical grooves formed in an outer peripheral surface thereof; and a casing that houses the screw rotor, the screw rotor including a main tapered portion having a tapered outer diameter that becomes larger from an intake side toward a discharge side of the screw rotor, and a reversely tapered portion that is located on a downstream side of a maximum outer diameter portion of the outer surface and on the discharge side of the main tapered portion, the reversely tapered portion having a reversely tapered outer diameter that becomes smaller as the reversely tapered portion extends away from the maximum outer diameter portion.

2. The single screw compressor structure according to claim 1, wherein the casing includes a first discharge port that opens at a location in an outer peripheral surface of the casing facing the reversely tapered portion.

3. The single screw compressor structure according to claim 2, wherein the casing includes a second discharge port that opens at a location in the outer peripheral surface of the casing on the intake side of the maximum outer diameter portion.

4. The single screw compressor structure according to claim 3, wherein the first discharge port and the second discharge port are arranged to communicate at the same time with an adjacent pair of the grooves formed in the outer peripheral surface of the screw rotor when the screw rotor rotates.

5. The single screw compressor structure according to claim 4, wherein the first discharge port and the second discharge port communicate with the outer peripheral surface of the casing.

6. The single screw compressor structure according to claim 5, wherein an outer diameter of a discharge side end portion of the outer surface of the screw rotor is larger than an outer diameter of an intake side end portion of the outer surface of the screw rotor.

7. The single screw compressor structure according to claim 4, wherein an outer diameter of a discharge side end portion of the outer surface of the screw rotor is larger than an outer diameter of an intake side end portion of the outer surface of the screw rotor.

8. The single screw compressor structure according to claim 3, wherein the first discharge port and the second discharge port communicate with the outer peripheral surface of the casing.

9. The single screw compressor structure according to claim 8, wherein an outer diameter of a discharge side end portion of the outer surface of the screw rotor is larger than an outer diameter of an intake side end portion of the outer surface of the screw rotor.

10. The single screw compressor structure according to claim 3, wherein an outer diameter of a discharge side end portion of the outer surface of the screw rotor is larger than an outer diameter of an intake side end portion of the outer surface of the screw rotor.

11. The single screw compressor structure according to claim 2, wherein an outer diameter of a discharge side end portion of the outer surface of the screw rotor is larger than an outer diameter of an intake side end portion of the outer surface of the screw rotor.

12. The single screw compressor structure according to claim 1, wherein an outer diameter of a discharge side end portion of the outer surface of the screw rotor is larger than an outer diameter of an intake side end portion of the outer surface of the screw rotor.

* * * * *